United States Patent [19]

Larsson et al.

[11] Patent Number: 4,461,272

[45] Date of Patent: Jul. 24, 1984

[54] KACHELOFEN

[76] Inventors: Peter Larsson, O. Schmiedgasse 7, A-8530 Duetschlandsberg; Franz Schaffer, Mittlerer Bahnweg 3, A-8523 Frauenthal a.d.L., both of Austria

[21] Appl. No.: 381,776

[22] Filed: May 25, 1982

[30] Foreign Application Priority Data

May 26, 1981 [AT] Austria ..... 2367/81

[51] Int. Cl.[3] ..... F24C 15/08

[52] U.S. Cl. ..... 126/64; 126/75; 126/151; 126/69

[58] Field of Search ..... 126/64, 69, 75, 76, 126/77, 121, 151, 73; 110/323, 339

[56] References Cited

U.S. PATENT DOCUMENTS

| | | | |
|---|---|---|---|
| 505,772 | 9/1893 | Larson | 126/69 |
| 510,714 | 12/1893 | Serebriakoff | 126/73 |
| 2,420,781 | 5/1947 | Klein et al. | 126/151 |
| 2,442,124 | 5/1948 | Gilmore | 126/73 |
| 2,481,069 | 9/1949 | Bole et al. | 126/68 |

FOREIGN PATENT DOCUMENTS

| | | | |
|---|---|---|---|
| 122133 | 4/1931 | Austria . | |
| 82309 | 9/1895 | Fed. Rep. of Germany . | |
| 202024 | 9/1908 | Fed. Rep. of Germany . | |
| 817498 | 10/1951 | Fed. Rep. of Germany . | |
| 220152 | 6/1942 | Switzerland . | |
| 5923 | of 1912 | United Kingdom | 126/76 |

*Primary Examiner*—Samuel Scott
*Assistant Examiner*—Margaret A. Focarino
*Attorney, Agent, or Firm*—Karl F. Ross; Herbert Dubno

[57] ABSTRACT

A stove for heating a room has three coaxially nested tubular columns formed of superposed rings of ceramic material, these columns defining an innermost channel rising above a combustion chamber to carry off evolving flue gases, an intermediate channel in which the flue gases descend, and an outermost channel which is subdivided by a cylindrical metallic partition into an inner and an outer cylinder section, the former serving as a duct for the escape of the flue gases to an elevated exhaust while the latter is traversed by air to be heated through that partition. Passages connecting the combustion chamber with the inner channel section help entrain an initial gas flow, during start-up, through the descending path of the intermediate channel.

7 Claims, 1 Drawing Figure

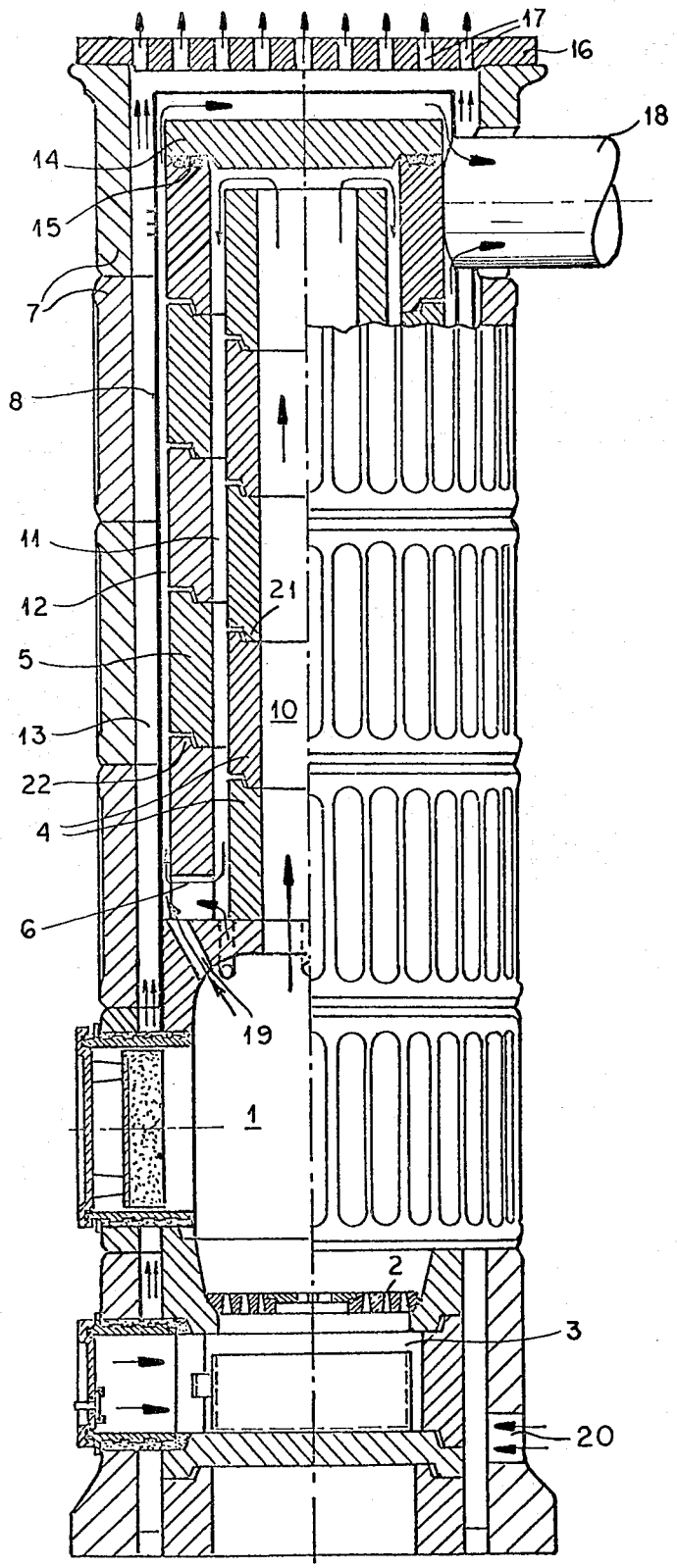
17
16
18
14
15
7
8
11
12
21
5
10
13
22
4
6
19
1
2
3
20

KACHELOFEN

FIELD OF THE INVENTION

Our present invention relates to a ceramic stove made from a plurality of nested tubular columns within which the flue gases rising from a combustion chamber are conducted in alternately ascending and descending paths to an exhaust.

BACKGROUND OF THE INVENTION

From German Pat. No. 202,024 a stove has become known wherein a stack of hollow ring members disposed above a combustion chamber define a central vertical duct surrounded by several annular compartments with inclined internal deflector and adjoining top and bottom apertures enabling flue gases rising through the central duct to descend progressively through the several annular compartments in each of which they describe a full circle. Air present in an annular channel bounded by a jacket surrounding the stack is heated by the circulating gases which escape through an outlet of the lowermost ring member.

The disadvantage of this known stove resides in the complicated construction of its ring members which can be manufactured only with relatively high expenditure. Moreover, the complicated guidance of the flue gases can quickly lead to considerable deposits, especially in the region of the deflectors and apertures, whereby the combustion in the stove is significantly impaired.

OBJECT OF THE INVENTION

The object of our present invention is to provide a stove of the type initially referred to in which these diadvantages are obviated and which is characterized by a simple structure and an optimum guidance of the flue gases.

SUMMARY OF THE INVENTION

This is achieved in that at least three concentric vertical flue-gas-conducting channels are formed from as many coaxially nested tubular columns each formed from stacked solid rings with interfitting end faces, at least the rings of an innermost and a middle column consisting of ceramic material; the flue gases rising in a central channel, defined by the innermost column, are deflected by a closed top of the middle column to descend on an intermediate channel before entering an inner section of an external channel in which they ascend to an exhaust located in the upper region of the stove as known per se. The rings are peripherally continuous so that no vertically extending joints are present. The rings can be easily and precisely formed, e.g. by extrusion or the like, since they are merely constituted by pipe sections. Rings of different diameters, being prefabricated, can be readily superposed to form the columns but can also be disassembled again whereby cleaning can be easily accomplished by taking the stove apart and separating the indiviual rings. Since the rings can be precisely prefabricated, the distance between the middle and outermost columns bounding the intermediate and outermost flue-gas channels can be exactly and easily maintained.

In contrast to known stoves, moreover, it is not necessary to pay particular attention to the relative position of the rings in their peripheral direction.

A further advantage of the stove according to our invention also resides in that, apart from the regions of deflection, there are only axially extending channels through which the flue gases are led. This results in a very simple guidance of the flue gases even though each ring of the ceramic columns is swept by these gases on both its cylindrical peripheral surfaces whereby a very good heat transfer is assured.

Since the hotter flue gases traverse a channel of smaller cross-section and the cooled flue gases of lesser buoyancy traverse one of larger cross-section, given by the larger mean diameter of the annular clearance between the innermost and intermediate columns, there results a uniform draft and a steady through-flow by the flue gas causing only minor soot deposits and facilitating a uniform heat transfer to a flow of ambient air passing vertically through an outer section of an external channel, bounded by the outermost column, which is radially separated by a coaxial cylindrical sheet-metal partition from an inner section of this external channel traversed by a rising gas flow approaching the exhaust. This enables a virtually direct heat exchange between the flue gases and the air to be heated, inasmuch as the sheet-metal partition is a good heat conductor.

Since the flue gases traversing the inner channel section have already passed at least once upward and at least once downward and have transmitted heat to the channel-bounding ceramic rings for storage, these gases are already sufficiently cooled to prevent undesirable combustion of dust particles by excessively high wall temperature of the outer channel section serving as an air duct. The use of a highly heat-conductive sheet-metal partition guarantees that the heat stored in the ceramic columns can be emitted, even after the end of combustion, with good efficiency and for an extended period down to very small temperature differences.

With the air duct open to the surrounding atmosphere at the bottom and at the top, air will normally pass through it upwardly by convection. We may, however, provide a blower which directs the air to be heated from above down past the sheet-metal partition. This has the result that the hot air exits at the bottom and causes an effect similar to that of floor heating, with uniform heating of the surrounding space from the bottom up.

Since the flue gases are made to flow first upward, then downward and thereafter again upward, difficulties may arise at the start-up of combustion on account of the necessary downflow since flue gases only move upward on their own. In order to obviate these difficulties we propose to provide passages which extend directly from the combustion chamber to the lower region of the inner section of the external channel, these passages being open at least at the start-up of combustion. Hot flue gas thus flows, at least initially, directly through these passages to the ascending conduit leading to the exhaust so as to entrain, on start-up, the combustion air also through the downwardly extending channel or channels. Depending on their size, the passages can be permanently open or else can be subject to throttling or blocking.

We prefer to make the rings of the outermost column, i.e. those which spacedly surround the sheet-metal partition and form the air duct between their inner surfaces and that partition, from porcelain. Their rings are heated by through-flowing air, which in turn is heated by the metallic partition, and thus acquire a temperature which is low relatively to the inner flue gases but still causes a pleasant feeling. The surface of porcelain offers considerable advantages since it is denser than earthenware or fireclay, does not absorb water and is easier to clean. Its appearance, as can be seen from historical fireplaces, is of excellent quality.

BRIEF DESCRIPTION OF THE DRAWING

The above and other features of our invention will now be described in more detail with reference to an embodiment shown in the accompanying drawing the sole FIGURE of which is an overall view of a ceramic stove in partial section.

SPECIFIC DESCRIPTION

The illustrated stove comprises a combustion chamber 1 separated by a grate 2 from an ash compartment 3 with draft control. Mounted on the combustion chamber are inner rings 4, surrounding a central channel 10, and middle rings 5, both made from fireclay or some other refractory heat-storing material. The column of middle rings 5 is surrounded by a sheet-metal jacket 8 which is also cylindrically shaped and which, for the maintenance of a clearance from the middle rings 5, is provided with spacing webs (not shown) bearing upon points of the middle rings and leaving an annular conduit or channel section 12. This sheet-metal jacket is surrounded by an outermost column consisting of rings 7 which are made of porcelain and which are so spaced from jacket 8, which is closed at the top, that there remains an annular channel section or duct 13 through which air heated at the jacket 8 can pass upward by convection or downward by means of a blower. Thus, conduit 12 and duct 13 form an inner and an outer section of an external channel partitioned by jacket 8. The air can enter through bottom apertures 20 (only one shown) and leave through top apertures 17 in a roof or cover member 16. The column of inner rings 4 forms a central channel for the rising flow of flue gases from combustion chamber 1; between the outer surface of the inner rings 4 and the inner surface of the middle rings 5, which are spaced from these inner rings, there is provided an intermediate channel 11 through which the flue gases can flow downward. Between the wall of combustion chamber 1 and the lowermost ring 4, separated therefrom by spacing blocks 6, a passage is provided that communicates with the duct 12 through which the flue gases flow upward. This duct 12 extends between a lid 14, supported on the uppermost middle ring 5 by way of seals 15, and the closure cap of jacket 8 to an exhaust 18. The start-up of combustion is facilitated by passages 19 (only one shown) between the combustion chamber 1 and the inner channel section 12. When the stove is ignited by the lighting of fuel in the combustion chamber 1, warm air flows through the passages 19 and channel section 12 to the exhaust 18 and draws downward, in the channel 11 existing between rings 4 and 5, the flue gases rising in the central channel 10 so that the start-up does not pose a problem. The passages 19, depending on their dimensions, can be left open throughout the entire heating process or can be throttled or closed. During the heating period the hot flue gases first come into contact with the inner rings 4 and strongly heat them by giving up some of their own heat. The heat remaining after the traverse of the channel 11, to whose boundaries formed by rings 4 and 5 heat is also transmitted, is given off by emission through partition 8 upon passage through inner channel section 12. Ambient air enters the outer channel section 13 through apertures 20 and flows upward by convection. As already noted, however, a blower could drive the air downward in duct 13, thus in counterflow to the flue gases in conduit 12, so that the cooler air contacts the cooler flue gases in the upper region of the stove and the warmer air absorbs heats from the still warmer flue gases via the sheet-metal jacket 8. This enhances the efficiency of direct heat absorption. There occurs furthermore a kind of floor heating affording a pleasant effect. The outer porcelain rings 7 are easily cleanable. Seating webs 21, 22 on the end faces of rings 4 and 5 enable an easy and close-fit assembly of the stove as well as a disassembly for a cleaning of the stove and of the channels 10, 11 and 12, 13. Thanks to the symmetrical arrangement of the channels and the conduction of the flue gases from the inside out, unequal flow conditions in cross-section are avoided and a uniform guidance of the flue gases with little soot deposition is achieved.

Since the hot flue gases at first heat only the inner and middle rings 4, 5, serving as heat storers, and bring the sheet-metal jacket 8 only to a temperature suitable for thermal convection of entering air, a combustion of dust particles contained in the air stream is avoided and the storage capacity of the ceramic material is fully utilized. This avoids also the risk that the outer stove wall grows too hot and that touching thereof might cause burns. Tests have shown that, on account of the chosen mode of convection, a very short start-up period up to heat emission is required, on the order of half an hour or less, whereas the afterheating period lasts eight to nine hours thanks to the storage capacity of the inner and middle rings 4 and 5 and their heating with the highest flue-gas temperature. With the use of a blower driving the air from the top down, or else of a blower aspirating the air from the bottom up, it is possible to reduce the temperature of the air leaving the stove, amounting through a blower to about 95° C., to 50° C.; these values can be varied according to the size of the rings, the number of rings to be stacked, i.e. the height of the stove, the power of the blower (if any), the temperature of the sheet-metal jacket, etc. The exit temperature of the flue gases ranges during the heating period between 100° and 120° C. which yields a very high efficiency of the stove.

We claim:

1. A room-heating stove comprising:

a combustion chamber;

a plurality of coaxially nested tubular ceramic columns rising above said combustion chamber and including an innermost column, a middle column and an outermost column, said innermost column forming a central channel carrying off flue gases evolving from said combustion chamber, said middle column being a boundary of an intermediate channel in which the flue gases ascending in said central channel are guided downward, said outermost column bounding an external channel; and a metallic partition coaxial with said columns radially subdividing said external channel into an annular inner section and an annular outer section, said inner section communicating with said intermediate channel for conducting said flue gases upwardly toward an exhaust near the top of said outermost column, said outer section being open at the top and at the bottom thereof toward the surrounding atmosphere for conducting a flow of ambient air to be heated by the rising flue gases in said inner section through contact with said metallic partition, at least said innermost and middle columns consisting of superposed rings of heat-storing refractory material.

2. A stove as defined in claim 1 wherein said middle column has a lid overlying an open top of said innermost column for deflecting rising gases from said central channel into said intermediate channel.

3. A stove as defined in claim 2 wherein said partition is part of a sheet-metal jacket forming a closure cap spacedly overlying said lid.

4. A stove as defined in claim 3 wherein said outermost column has a cover spacedly overlying said closure cap and having apertures connecting said outer section with the atmosphere.

5. A stove as defined in claim 1 wherein said rings have end faces with interfitting formations.

6. A stove as defined in claim 1, 2, 3, 4 or 5 wherein said outermost column consists of superposed rings of porcelain.

7. A stove as defined in claim 1, 2, 3, 4 or 5 wherein said combustion chamber is provided with passages leading into said inner section for promoting the circulation of flue gases through said intermediate channel during a start-up phase.

* * * * *